US006267261B1

(12) United States Patent
Lesage

(10) Patent No.: US 6,267,261 B1
(45) Date of Patent: Jul. 31, 2001

(54) CAVITATED INSULATING SUPPORT BASE FOR HOT WATER TANK

(75) Inventor: Claude Lesage, Pointe Claire (CA)

(73) Assignee: Giant Factories Inc., Québec (CA)

( * ) Notice: Subject to any disclaimer, the term of this patent is extended or adjusted under 35 U.S.C. 154(b) by 0 days.

(21) Appl. No.: 09/526,452

(22) Filed: Mar. 16, 2000

(51) Int. Cl.[7] ..... A47G 23/02
(52) U.S. Cl. ..... 220/567.3; 220/636
(58) Field of Search ..... 220/567.3, 636, 220/634, 638; 248/146, 149

(56) References Cited

U.S. PATENT DOCUMENTS 4,860,728 * 8/1989 Nelson ..... 220/567.3
4,957,097 * 9/1990 Chevalier et al. ..... 220/567.3
4,972,967 * 11/1990 Nelson ..... 220/567.3
5,040,697 * 8/1991 Nelson ..... 220/567.3
5,178,351 * 1/1993 Lesage ..... 220/636

* cited by examiner

*Primary Examiner*—Joseph M. Moy
(74) *Attorney, Agent, or Firm*—Swabey Ogilvy Renault; Guy J. Houle

(57) ABSTRACT

A hot water tank is comprised of a cylindrical disc-shaped support base on which is supported a cylindrical inner tank concentrically therewith. A circumferential ridge projects upwardly adjacent an outer peripheral edge of the support base and spaced from a lower edge portion of a circumferential side wall of the inner tank to form a circumferential containment channel between the ridge and the lower edge portion. The channel has a volume sufficient to receive a lower portion of a plastic film pouch wrapper disposed at least about a lower section of the inner casing as well as a pre-determined quantity of hot expandable liquid urethane placed therein in sufficient quantity to fill a space between the inner casing and an outer shell secured spaced about the inner casing when the urethane is expanded. The channel prevents the liquid urethane from flowing out of the lower portion of the wrapper located therein due to deterioration of the wrapper when exposed to the hot liquid urethane.

9 Claims, 3 Drawing Sheets

CAVITATED INSULATING SUPPORT BASE FOR HOT WATER TANK

TECHNICAL FIELD

The present invention relates to a hot water tank cavitated insulating support base which defines a containment channel to receive a lower edge portion of a plastic film wrapper in which is injected hot liquid urethane whereby to contain the liquid urethane in the lower portion of the bag when injected thereto to prevent the quickly expanding urethane from flowing out of the wrapper and out of the outer casing through crevices provided around pipe fittings or other areas of the outer shell.

BACKGROUND OF THE INVENTION

Description of Prior Art

Insulation support bases for hot water tanks are known. In my U.S. application Ser. No. 826,603 entitled "Insulating Support Base for a Cylindrical Electrical Hot Water Tank", now U.S. Pat. No. 5,178,351 issued Jan. 12, 1993, I disclose the construction of an insulating support base formed of rigid insulating foam material whereby to support the bottom wall of the inner casing of a hot water tank and to facilitate centering of the outer casing thereabout. U.S. Pat. No. 5,180,077 also discloses a water heater bottom insulating disc wherein there is provided an upwardly convex center portion which mates with the concave base of the inner tank whereby to completely support the water heater and its water content. However, the center portion does not only support the inner tank, but at the same time, provides a better insulation than known prior art. These discs also permit centering of the inner casing and proper uniform spacing of the outer casing. Both these devices provide some thermal insulation to the base of the water heater.

In order to insulate the space between the inner casing side wall and the side wall of the outer casing, a sheet of insulating wool, such as Fiberglass® insulation, is usually folded over the entire inner casing from the top thereof and collapsed over the inner casing whereby to embrace the casing from both sides thereof. The insulating sheet may also be wrapped around the side wall of the water heater and a circular disc of insulation material placed on top of the heater. With these methods of insulation, it has been found that, in most cases, the insulating wool does not extend fully to the bottom of the casings and voids are created between the inner casing and outer casing adjacent the support disc spacing peripheral flange and elsewhere. Tests have shown that these voids in the side wall insulation results in heat loss in the tank bottom end and, therefore, energy inefficiency. By using expandable foam urethane much of the above disadvantages have been overcome. However, when using expandable urethane it is necessary to mask all crevices or holes in the outer casing and to introduce temporary plugs whereby to prevent expanded urethane to flow out of the outer casing or to obstruct areas where fittings need to be installed such as piping, etc.

Recently there was developed a need to recycle hot water tanks and at least the outer steel casing thereof. However, this was time consuming because the urethane foam had to be scrapped away from the inside wall of the inner casing. The use of plastic sheet wrappers was developed to solve this problem whereby the wrappers would protect the inside wall of the outer casing to prevent the expanded foam to adhere thereto. My U.S. Pat. No. 5,178,351, discusses such a wrapper and related prior art. The wrappers are formed of plastic film material and have one major disadvantage, that being that when the hot urethane is injected therein the wrapper bursts or melts due to the excessive heat of the liquid urethane which exceeds beyond the melting point of the wrapper and some of the urethane flange between the wrapper and the inner tank wall and between the wrapper and the outer casing at the base portion of the wrapper. As the foam quickly expands it quickly flows out of the outer casing through the gaps existing around the pipe fittings and the outer casing. Up to 50–60% of the material can escape through these gaps and when this happens the hot water tank is rendered unusable and needs to be recycled. This is very time consuming and costly.

It is also well known in the art that bacteria contamination of water in hot water heaters is susceptible in the lower end of the hot water heater where the temperature of the water is at its lowest. This phenomena is clearly described in Canadian Patent 2,030,976 issued on May 29, 1992 to Hydro Quebec and there is a brief description in that patent of the need to maintain the water temperature as high as possible in the lower tank region. However, this has proven difficult. It is therefore essential that the lower portion of the tank be properly insulated and this has been heretofore difficult to achieve due to the insulating methods utilized during the fabrication of hot water heaters. Reference is made to my Canadian Patent Application serial No. 2092348 published on Sep. 25, 1994 where I discuss this problem and present a solution but limited to the use of Fiberglass® wool

SUMMARY OF THE INVENTION

It is therefore a feature of the following to provide a cavitated insulating support base for a hot water tank which overcomes the above-mentioned disadvantages of the prior art.

Another feature of the present invention is to provide a hot water tank assembly including a cavitated insulating support base provided with a circumferential containment channel to receive the lower end portion of a plastic film or wrapper and a predetermined quantity of hot expandable liquid urethane placed in the wrapper in sufficient quantity to fill the space between the inner casing of the hot water heater and the outer shell thereof.

Another feature of the present invention is to provide a cavitated insulating support base for a hot water tank and wherein a circumferential containment channel is integrally formed therewith.

Another feature of the present invention is to provide a cavitated insulating support base for a hot water tank and wherein a containment channel is formed about an outer top preripheral portion of the support base by an outer circumferential flange which is spaced from the inner tank outer side wall.

According to the above features, from a broad aspect, the present invention provides a hot water tank is comprised of a cylindrical disc-shaped support base on which is supported a cylindrical inner tank concentrically therewith. A circumferential ridge projects upwardly adjacent an outer peripheral edge of the support base and spaced from a lower edge portion of a circumferential side wall of the inner tank to form a circumferential containment channel between the ridge and the lower edge portion. The channel has a volume sufficient to receive a lower portion of a plastic film pouch wrapper disposed at least about a lower section of the inner casing as well as a predetermined quantity of hot expandable liquid urethane placed therein in sufficient quantity to fill a space between the inner casing and an outer shell secured spaced about the inner casing when the urethane is expanded. The channel prevents the liquid urethane from flowing out of the lower portion of the wrapper located therein due to deterioration of the wrapper when exposed to the hot liquid urethane.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1:
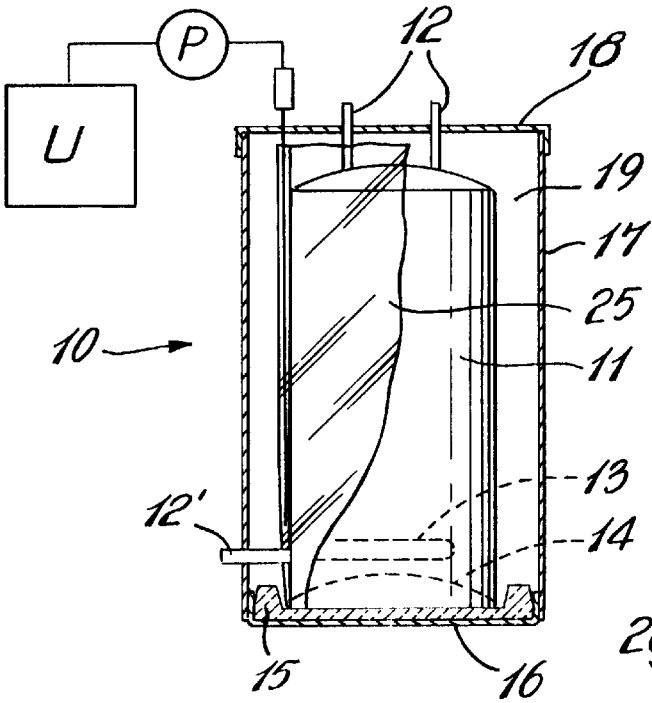
FIG. 1 is a simplified fragmented section view showing the construction of a hot water tank utilizing the cavitated insulating support base of the present invention.

Referring now to the drawings and more particularly to FIG. 1 there is shown generally at 10 the basic construction of a hot water tank. It comprises an inner tank 11 in which water is heated by a heating device not shown, such as electrical resistive elements or a burner mounted in the base of the hot water tank, as is well known in the art. The inner tank 11 is provided with pipe fittings 12 or other fittings such as 12' which lead to the internal resistive elements 13, herein shown in phantom lines located inside the inner tank. The inner tank 11 has a dome shape bottom wall 14 and the inner tank sits on a insulating support base 15, the construction of which will be described later. The insulating support base is positioned for close fit within a pan 16 about which is secured the cylindrical outer casing 17. A top cover 18 is secured over the top end of the outer casing 17. The side wall and cover are spaced from the outer wall of the inner tank 11 to define an insulating space 19.

Figure 2:
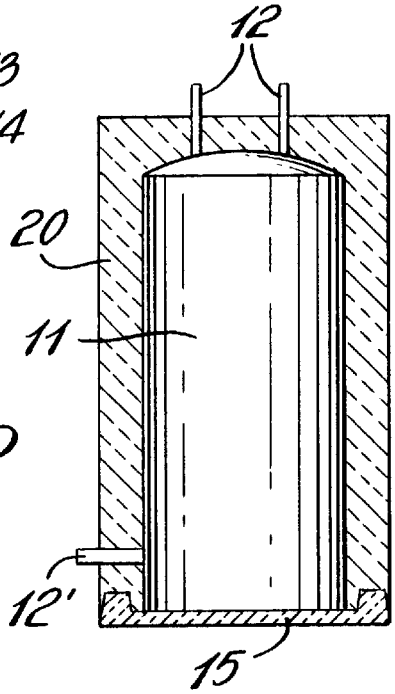
FIG. 2 is a section view showing a hot water tank utilizing the cavitated insulating support base of the present invention illustrating the expanded urethane insulating foam in relation to the inner casing and outer shell of a hot water tank.

As shown in FIG. 2 a urethane foam material 20 is injected within the space 19 and expands all about the inner tank 11 and the pipe fittings 12 or the other fittings 12' to insulate the inner tank to prevent heat loss. The insulating base 15 is made of an insulating foam material and also access an insulator.

Figure 3:
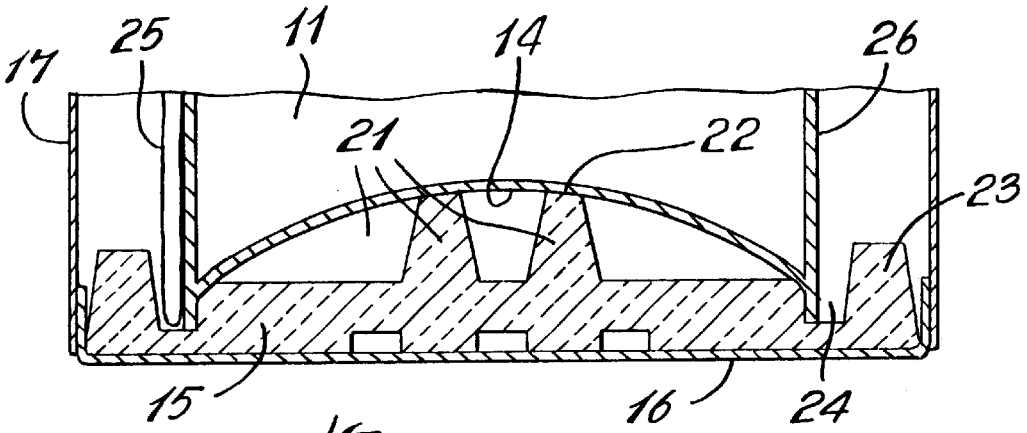
FIG. 3 is a section view showing the constructions of the cavitated insulating support base and its relation to the inner casing and the outer shell.
Figure 4:
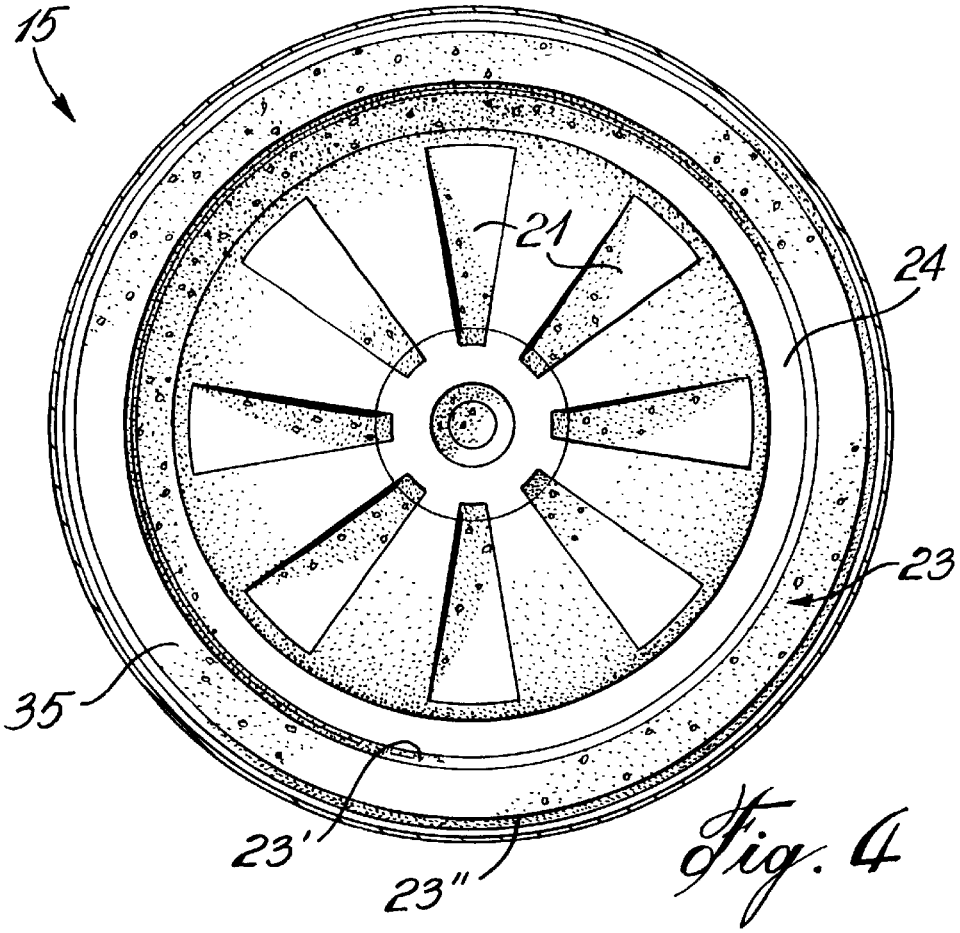
FIG. 4 is a top view of the cavitated insulating support base.

Referring now to FIGS. 3 and 4 there is shown the construction of the cavitated insulating support base 15 of the present invention. As herein shown the insulating support base 15 is formed with a plurality of ribs 21 which have a curved outer surface 22 for close support engagement with the dome shape bottom wall 14 of the inner tank 11 to provide support of the tank. As shown in FIG. 4 the insulating support base 15 is formed as a circular disc and has integrally formed therein a circumferential outer ridge 23 which is spaced at predetermined distance from the ribs 21 to define a containment channel 24 therebetween.

As shown in FIG. 3 the containment channel 24 is adapted to receive the lower edge portion 11' of the inner tank 11 therein and to provide a containment channel 24 between the inner side wall 25 of the circumferential ridge 23 and the outer side wall 26 of the inner tank 11.

Figure 5:
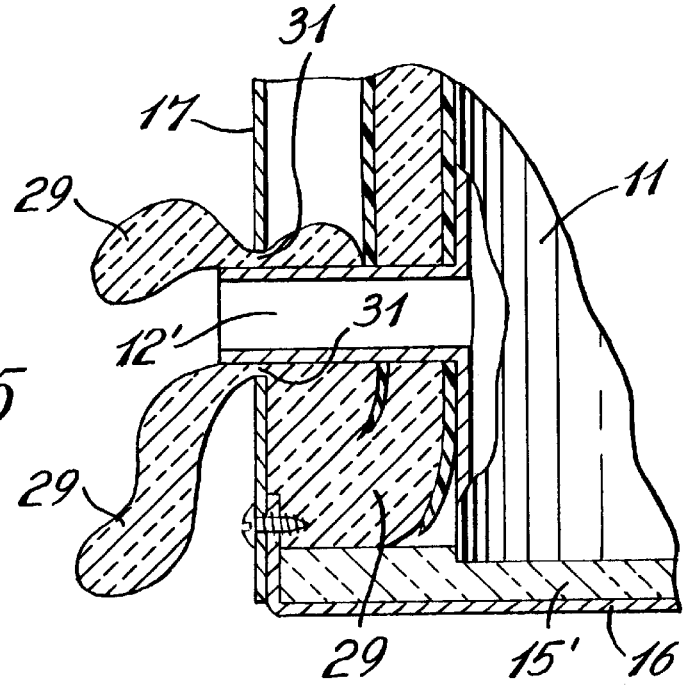
Fig. 5 (PRIOR ART)
FIG. 5 is a fragmented view of a lower section of a prior art hot water heater illustrating a problem solved by the present invention.
Figure 6:
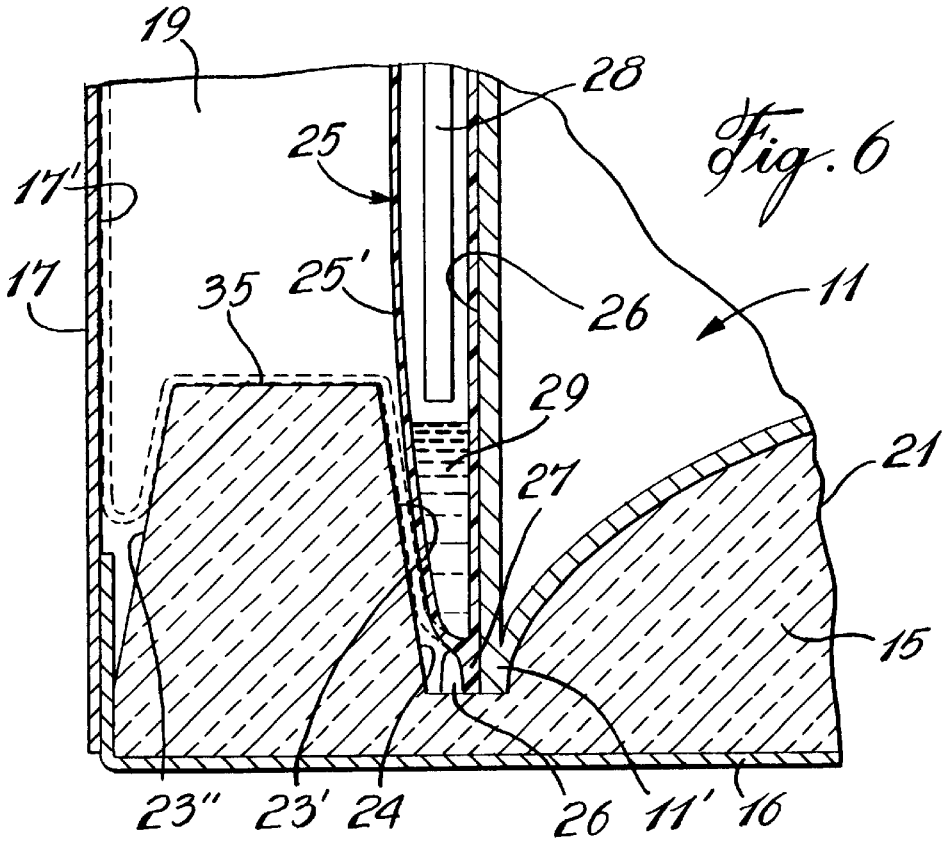
FIG. 6 is an enlarge section view illustrating the construction of the cavity and the position of the lower circumferential edge section of the plastic film wrapper with the liquid urethane injected therein.

With further reference to FIG. 6 there is shown a lower portion of a plastic film pouch 25 being received within the containment channel 24 and secured therein by securing means such as a tape 26 and adjacent the lower edge portion 11' of the inner tank 11. This plastic film pouch wrapper 25 is a bag-like wrapper having a sealed lower end 27 and its purpose is to contain the expandable foam 18 therein whereby the foam does not adhere to the inner surface 17' of the outer casing 17. As well, it protects the outer surface 26 of the inner casing 11, at least in major portion thereof, from the expandable foam so that the foam does not adhere thereto. As previously mentioned, this facilitates recycling of the outer casing as well as the inner tank. The insulating foam 18 is injected in the bottom of the plastic film pouch wrapper 25 by an injection nozzle, herein illustrated by reference numeral 28 which is inserted within a top end of the plastic film pouch 25 and lowered to the base portion of the pouch which is located in the containment cavity 24. This foam is a hot liquid urethane which is usually at a temperature of about 250° F. Because the plastic film pouch is a polyethylene bag, the bag will start melting as soon as the hot urethane is injected therein and this often causes the bag to melt and the hot urethane to flow out of the bag, shown in FIG. 5.

FIG. 5 illustrates the problem solved by the present invention. As hereinshown if the lower edge of the plastic bag is punctured by the hot urethane or is dissolved, the hot urethane, which usually reaches its total expansion in 4 sec. will quickly flow out of cavities or crevices 30 which are present about pipe fittings, such as the fitting 12' which are formed between preformed holes 31 formed in the outer casing 17. These holes are usually formed large enough whereby to receive pipe fittings which may be slightly offset and accordingly these crevices are fairly large and because some are located in the lower end portion of the tank a substantial portion of this urethane material can escape through these crevices due to its quick expansion. It has been found that sometimes 50–60% of the foam could escape through these crevices and in such instances it was necessary to discard the hot water tank as it would be too costly to recycle them because some of the foam would have adhered to the lower portion of the outer casing and inner tank.

With the containment channel 24 of the present invention, it can be seen from FIG. 6 that as the hot urethane 29 is injected within the lower portion of the plastic pouch wrapper 25 that it is contained therein by the containment channel 24 and even if the lower section of the pouch melts, due to the quick expansion of the urethane the pouch outer side walls 25' will be displaced, as shown in 5 phantom lines at 25" to protect the inner surface 17' of the outer casing 17.

Figure 7:
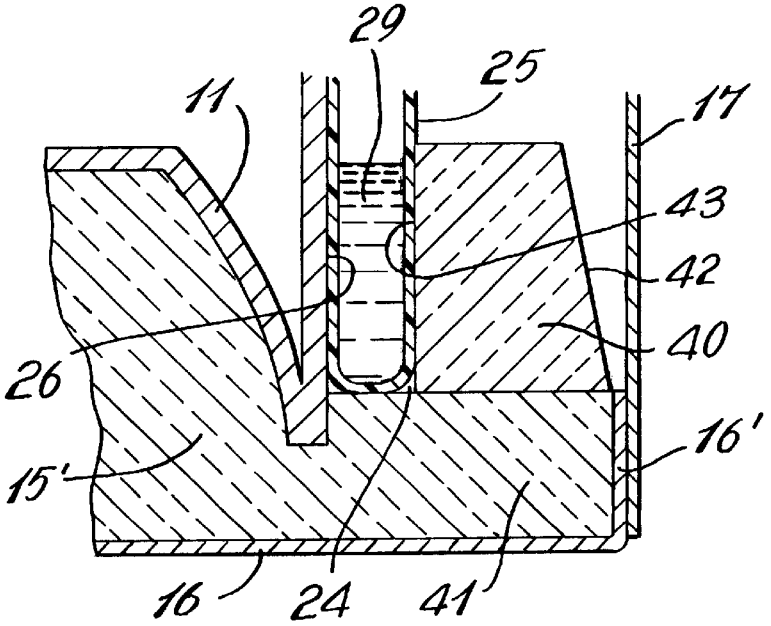
FIG. 7 is a view similar to FIG. 6 but showing the circumferential containment channel formed with a separate circumferential ring or flange.

FIG. 7 shows a further embodiment of the present invention and wherein the support base is formed of two sections and namely a circular disc section 15' and a circumferential ring or ridge 40 which is separated therefrom and which is adapted to rest on a circumferential flange portion 41 of the support disc 15'. The circumferential flange 40 is dimensioned to be closely spaced to the outer casing 17 and has a sloped outer side wall 42 to facilitate inserting the lower edge of the outer casing over the tank and about the circumferential side wall 16' of the pan 16 the inner side wall 43 of the circumferential flange 40 may be a straight or inclined wall and it is spaced from the outer surface 26 of the inner tank 11 a predetermined distance defines the containment cavity 24. As herein shown the lower section of the film pouch wrapper 25 rests within this channel and the channel is dimensioned to receive the hot liquid urethane 29 therein to achieve the objects of the present invention.

The insulating support base 15 is well known in the art and it is formed of a molded polyurethane material. As shown in FIG. 6 the central dome section formed by the ribs 21 as well as the circumferential ridge 23 are integrally formed and spaced from one another to define the containment channel 24. The circumferential ridge 23 has an inner and outer side wall 23' and 23" which slope inwardly toward a flat top wall 35. The outer side wall 23" facilitates insertion of the outer casing over the bottom pan, as previously described and the sloping inner side wall 23' merely facilitates the outer wall 25' of the film pouch wrapper 25 to separate and extend towards the inner surface 17' of the outer casing 17 as shown in FIG. 6.

It is within the ambit of the present invention to cover any other obvious modifications of the preferred embodiments described herein, provided such modifications fall into the scope of the appended claims.

What is claimed is:

1. A hot water tank comprising a circular disc-shaped support base for supporting a cylindrical inner tank concentrically in a lower circular pan, a circumferential ridge projecting upwardly adjacent an outer peripheral edge of said support base and spaced from a lower edge portion of a circumferential side wall of said inner tank to form a circumferential containment channel between said ridge and said lower edge portion, said channel having a volume sufficient to receive a lower portion of a plastic film pouch wrapper disposed at least about a lower section of said inner tank as well as a predetermined quantity of hot expandable liquid urethane placed therein in sufficient quantity to fill a space between said inner tank and an outer secured spaced about said inner tank, said channel preventing said liquid urethane from flowing out of said lower portion of said wrapper located therein due to deterioration of said wrapper, when exposed to said hot liquid urethane.

2. A hot water tank as claimed in claim 1 wherein said ridge is integrally formed with said base.

3. A hot water tank as claimed in claim 2 wherein said support base is a molded polyurethane thermally insulating base.

4. A hot water tank as claimed in claim 3 wherein said support base has a central dome section configured for support contact with a concave bottom wall of said inner tank for supporting a major portion of the load of said inner casing.

5. A hot water tank as claimed in claim 2 wherein said ridge is positioned over an outer circumferential flange of said base extending between said inner tank and said outer casing.

6. A hot water tank as claimed in claim 2 wherein said ridge has an inner and outer side wall and a top wall, said outer side wall and inner side wall slopping inwardly toward said top wall, said slopping outer side wall facilitating the positioning of a lower circumferential portion of said outer casing about said support base for engagement with said circular pan, said slopping inner side wall defining an outer side wall of said containment channel.

7. A hot water tank as claimed in claim 6 wherein said top wall is a flat narrow top wall.

8. A hot water tank as claimed in claim 1 wherein said plastic film pouch wrapper is a double wall wrapper having a sealed lower edge for containment of said liquid urethane and for preventing said expandable foam to adhere to a substantial portion of an inner wall of said outer casing and a portion of an outer wall of said inner tank to facilitate recycling thereof.

9. A hot water tank as claimed in claim 1 wherein said hot expandable urethane is injected into said lower portion of said plastic film pouch wrapper at a temperature of 250° F.

* * * * *